US007614431B2

(12) United States Patent
Basista et al.

(10) Patent No.: US 7,614,431 B2
(45) Date of Patent: Nov. 10, 2009

(54) FUEL FLOW RESTRICTION PLUG FOR RECIRCULATION PIPE

(75) Inventors: Jeffrey S. Basista, Milford, MI (US); Roy A. Giacomazzi, Auburn Hills, MI (US); Peter N. C. Nguyen, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 508 days.

(21) Appl. No.: 11/457,227

(22) Filed: Jul. 13, 2006

(65) Prior Publication Data

US 2008/0011387 A1 Jan. 17, 2008

(51) Int. Cl.
*B65B 1/04* (2006.01)

(52) U.S. Cl. ..... 141/286; 141/285; 123/518; 137/15.24

(58) Field of Classification Search ..... 141/59, 141/285, 286; 123/518, 519; 62/48.1; 220/86.2; 137/15.24
See application file for complete search history.

(56) References Cited

U.S. PATENT DOCUMENTS

| | | | | | |
|---|---|---|---|---|---|
| 4,699,638 | A | * | 10/1987 | Harris | 96/113 |
| 4,741,369 | A | * | 5/1988 | Dawson | 141/286 |
| 4,809,863 | A | * | 3/1989 | Woodcock et al. | 220/746 |
| 4,932,444 | A | * | 6/1990 | Micek | 141/59 |
| 5,033,517 | A | * | 7/1991 | Bucci | 141/59 |
| 5,275,213 | A | * | 1/1994 | Perkins | 141/59 |
| 6,029,719 | A | * | 2/2000 | Hor et al. | 141/348 |
| 7,311,088 | B1 | * | 12/2007 | Callahan et al. | 123/519 |

* cited by examiner

*Primary Examiner*—Timothy L Maust

(57) ABSTRACT

A flow-restricting plug is provided for installation within a vapor recirculation pipe that communicates with a fuel filler pipe. The plug is manufactured of fuel-impervious material and has a cylindrical shape adapted to be mounted by press fit within the vapor recirculation pipe. A flow passage of tortuous shape is formed along the outer circumferential surface of the plug between the opposed ends thereof. The tortuous shape of the flow passage permits the flow of fuel vapor through the plug but prevents the flow of liquid fuel through the plug.

9 Claims, 4 Drawing Sheets

FUEL FLOW RESTRICTION PLUG FOR RECIRCULATION PIPE

FIELD OF THE INVENTION

The present invention relates to a fuel vapor control system for motor vehicles and more particularly to a flow-restricting plug for permitting the venting of fuel vapor through a vapor recirculation pipe but preventing liquid fuel from entering the vapor recirculation pipe.

BACKGROUND OF THE INVENTION

It is known in modern motor vehicles to provide a fuel system that includes a fuel filler pipe through which the fuel tank can be filled with liquid fuel such as gasoline or ethanol. The vehicle is refueled by inserting a service station nozzle into the funnel of the fuel filler pipe and then pumping the liquid fuel down the fuel filler pipe to the tank.

In order to limit the expulsion of fuel vapor into the atmosphere, modern vehicles are equipped with onboard vapor recovery systems, one element of which is a vapor recirculation pipe that extends between the fuel filler pipe and the fuel tank. The vapor recirculation pipe is intended to recirculate fuel vapors between the fuel tank and the funnel region of the fuel filler pipe. However, during the filling of the tank, conditions can occur in which liquid fuel is splashed into the vapor recirculation pipe, for example in the event of a malfunction of the service station nozzle, or an operating error by the person filling the tank.

Accordingly, the prior art has employed an orifice-like plug that is positioned within the recirculation pipe to allowing a metered volume of fuel vapor flow but limit fuel liquid flow.

SUMMARY OF THE INVENTION

The invention provides a new and improved liquid flow preventing plug for installation into a fuel vapor recirculation pipe to discriminate between liquid and vapor. The liquid flow preventer is a flow-restricting plug manufactured of fuel-impervious material and has a cylindrical shape adapted to be press fit within the vapor recirculation pipe. A flow passage of tortuous shape is formed along the outer circumferential surface of the plug between the opposed ends thereof. The tortuous shape of the flow passage permits the flow of fuel vapor through the plug but prevents the flow of liquid fuel through the plug.

Further characteristics of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
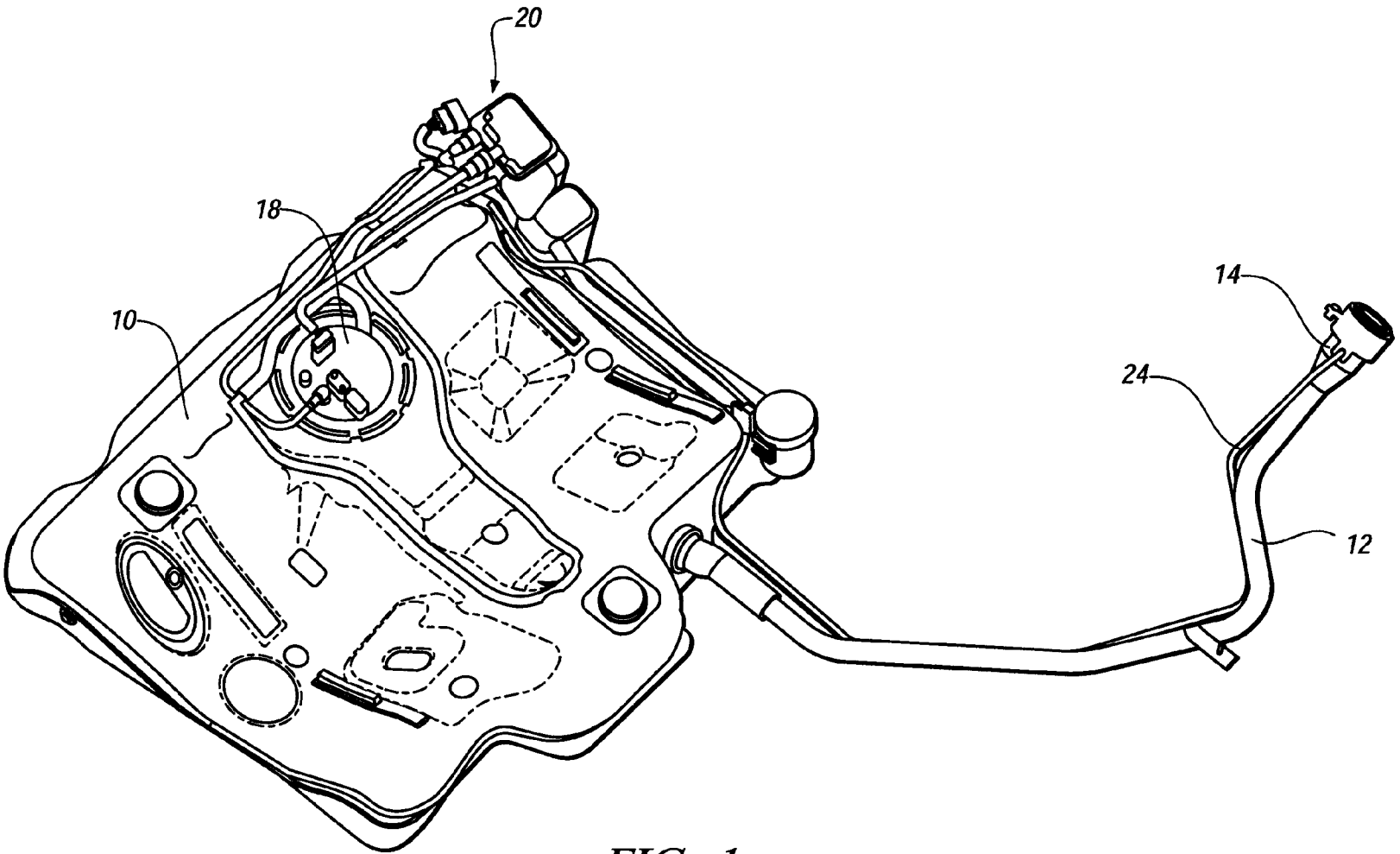
FIG. 1 is a perspective view of a fuel tank system.

Referring to FIG. 1, a vehicle fuel tank system is shown, including a fuel tank 10 and a fuel filler pipe 12. The upper end of the fuel filler pipe 12 includes a funnel 14, which is suitably mounted on the vehicle body and is conventionally accessed through a fuel filler door, not shown, that is also mounted on the vehicle. The lower end of the fuel filler pipe 12 is connected to the fuel tank 10. In order to fill the fuel tank 10 with fuel, a service station nozzle is inserted into the upper end of the fuel filler pipe 12 and fuel flows down the fuel filler pipe 12 to the fuel tank 10.

FIG. 1 also shows that the fuel tank 10 carries an in-tank fuel pump 18 and an onboard vapor recovery system, generally indicated at 20. The onboard vapor recovery system 20 includes various pipes, valves, and other components, which will vary in structure and operation as taught by the prior art.

Figure 2:
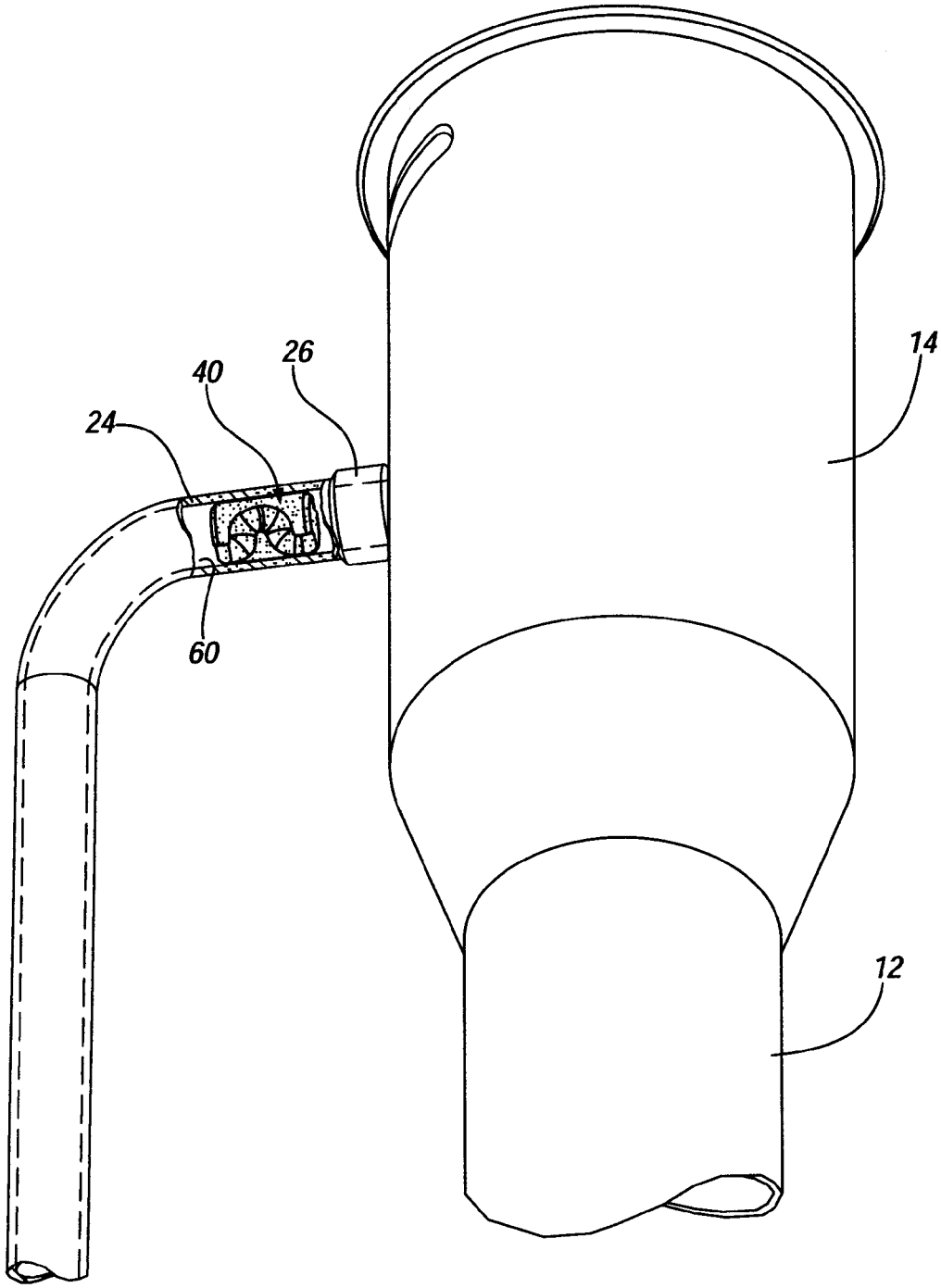
FIG. 2 is an elevation view, having parts broken away and in section, showing a vapor recirculation pipe having a flow-restricting plug.

One component of the vapor recovery system 20 is a vapor recirculation pipe 24. As best seen in FIG. 2, the vapor recirculation pipe 24 has a connector portion 26 that communicates with the funnel 14 of fuel filler pipe 12. The lower end of the vapor recirculation pipe 24 is connected with the fuel tank 10, either directly or through a connection to the on board vapor recovery system 20. Upon filling of the fuel tank 10, fuel vapor is conducted through the vapor recirculation pipe 24, most typically in the direction to relieve pressure within the fuel tank 10 by venting a portion of the fuel vapor into the funnel 14, where the vapor can be scavenged by a vapor-scavenging system, not shown, that is carried by the service station nozzle, or recirculated back down the fuel filler pipe 12 to the fuel tank 10.

Figure 4:
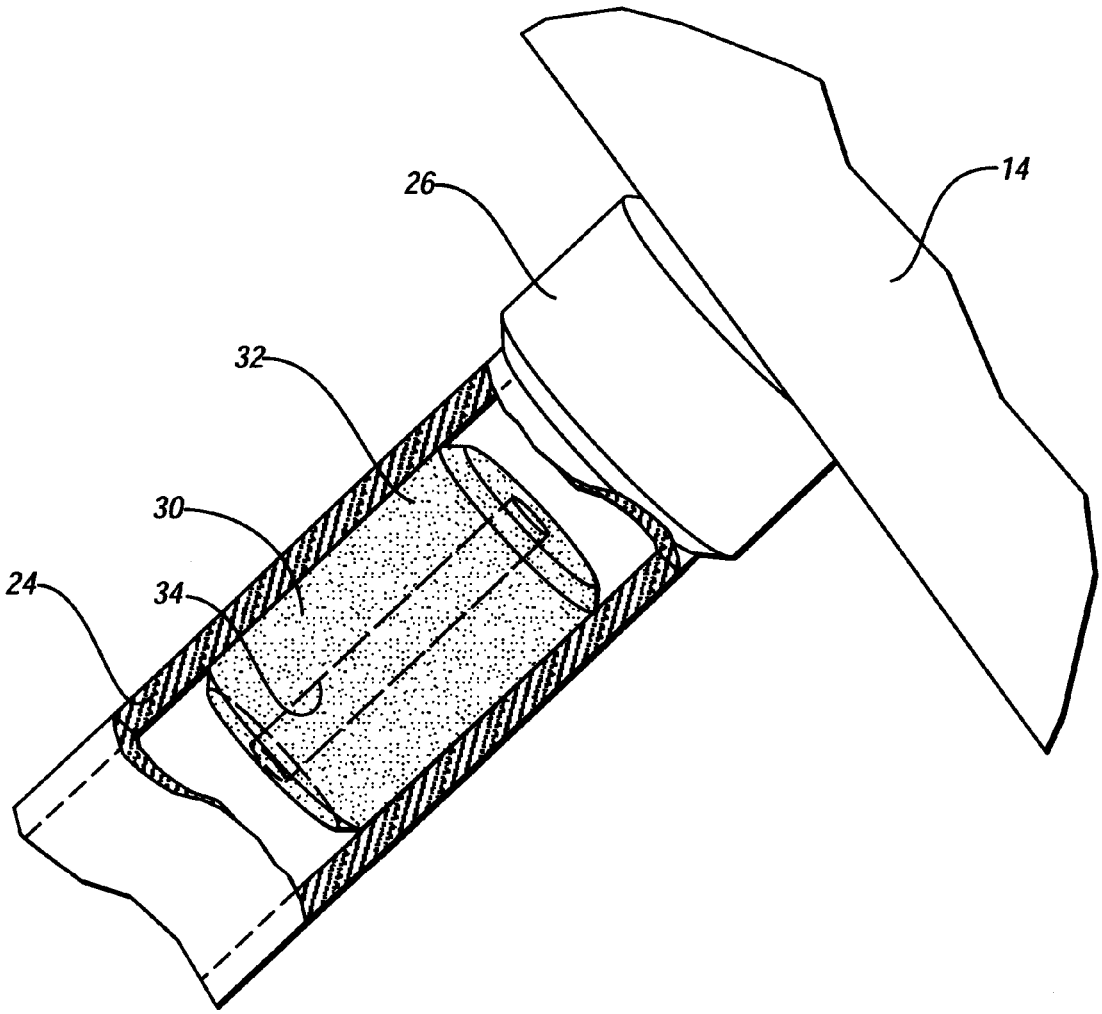
PRIOR ART FIG. 4
FIG. 4 is a perspective view of the flow-restricting plug.

FIG. 4 shows a prior art device 30 for preventing the flow of liquid fuel through the vapor recirculation pipe 24. During the filling of the tank 10, conditions can occur in which liquid fuel is inadvertently splashed into the vapor recirculation pipe 24, for example in the event of a malfunction of the service station nozzle, or an operating error by the person filling the tank. The device 30 is a plug 32 that is inserted into the upper end of the vapor recirculation pipe 24. The plug 32 has a small orifice 34 of 0.100 inches diameter that is drilled through the plug 32. The small diameter of the orifice 34 permits fuel vapor to pass through the plug 32, but will limit the flow of liquid fuel because of the small diameter of the orifice.

Figure 3:
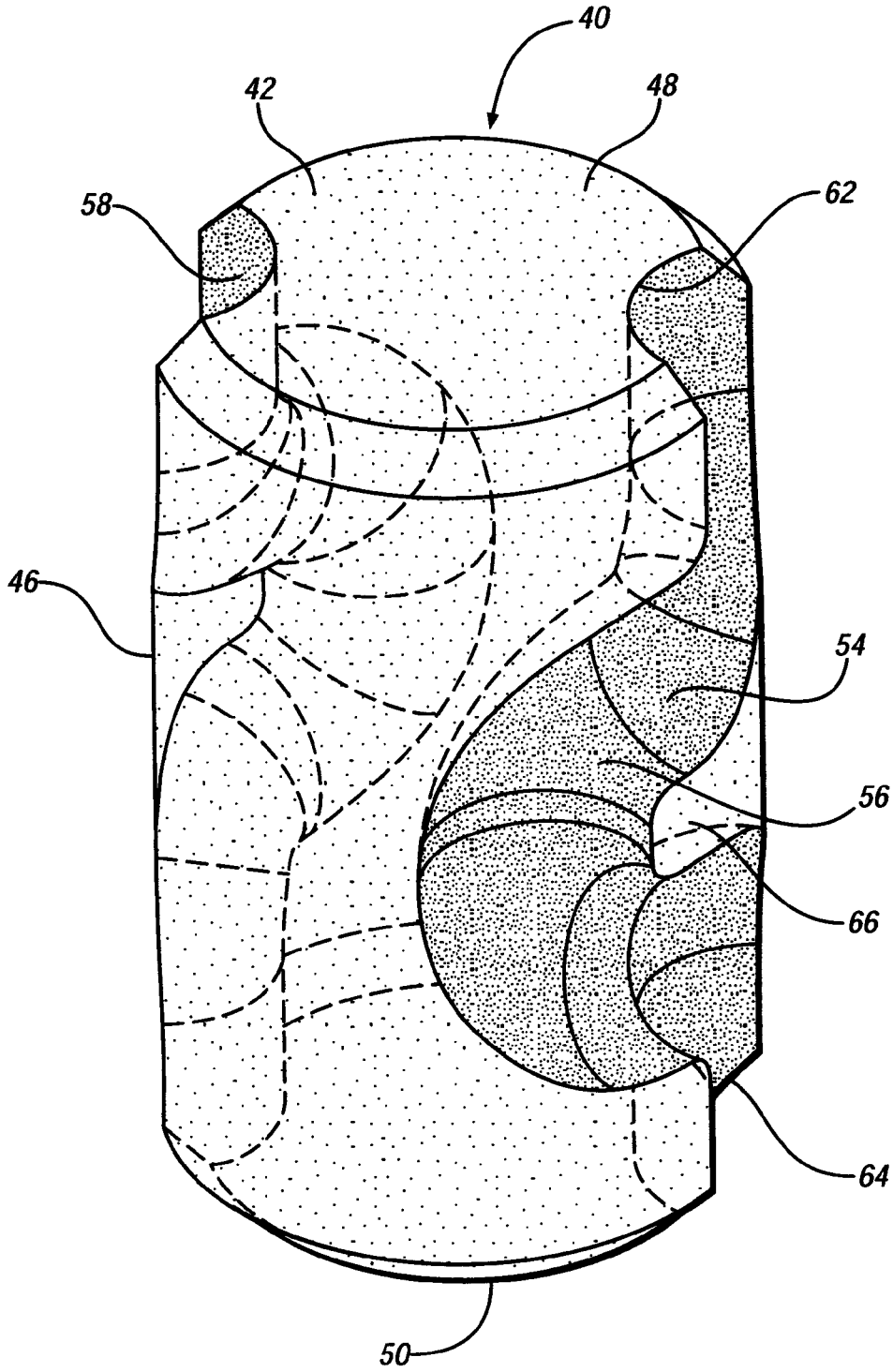
FIG. 3 is an enlargement of FIG. 2.

FIGS. 2 and 3 show a new and improved fuel flow restriction device 40 for blocking the flow of liquid fuel through the vapor recovery pipe 24 connected to the funnel 14 by connector portion 26. As best seen in FIG. 3, the flow restriction device 40 is a plug 42 of cylindrical shape and includes an outer cylindrical surface 46, an upper end 48, and a lower end 50. A tortuous passage 54 is provided on the outer surface of the plug 42 and is in the form of a meandering channel 56 that is provided in the outer cylindrical surface 46 and reaches from a first end opening 62 in the upper end 48 and a second end opening 64 in the lower end 50 of the plug 42. As seen in FIG. 4, the meandering channel 56 twists and bends around an embankment 66 so that there is no line of sight between the first end opening 62 and the second end opening 64. A second tortuous passage 58 is also provided on the outer cylindrical surface 46, diametrically opposed to the tortuous passage 54, and is also in the form of a meandering channel that is provided on the outer cylindrical surface 30 and reaches from the upper end 48 to the lower end 50.

The plug 42 is preferably manufactured of sintered powder metal by a manufacturing process in which metal powder and a suitable composition of binders are compressed between molds halves that have a cavity in the shape of the plug 42. The compressed powder metal pre-form is then extracted from the molds and sintered in an oven or other heat source to bind the metal powder and form the finished plug 42. The use of powder metal for the manufacture of the plug 42 is desirable as the metal is impervious to the fuel. Other material, such as plastic, and other manufacturing processes, such as plastic injection molding, can be used to manufacture the plug 42. The location of the tortuous passages 54 and 58 on the outer surface of the plug 42 has the advantage of facilitating the molding process as the mold features that form the meandering channels can be easily extracted and no movable pins or other complicated mold devices are needed to form the meandering channels.

The flow restriction device 40 is inserted into press fit within the inside pipe wall 60 of the vapor recovery pipe 24 as seen in FIG. 2, thus closing the open sides of the tortuous passages 54 and 58 and forming a flow passage through the plug 42. Fuel vapor has a very low viscosity and can freely pass through the tortuous passages 54 and 58. However, the liquid fuel has a higher viscosity and cannot as easily pass through the tortuous passages 54 and 58.

The foregoing description of the invention is merely exemplary in nature and, thus, variations thereof are intended to be within the scope of the invention. For example, the flow restriction device can be designed to have one, two, or more of the tortuous passages formed on it outer cylindrical surface. In addition, the number and the size of the tortuous passages can be determined and chosen to obtain the desired level of performance in discriminating between vapor and liquid.

What is claimed is:

1. A flow-restricting plug for installation within the inside pipe wall of a vapor recirculation pipe that communicates with a fuel filler pipe, comprising:

a cylindrical-shaped plug constructed of fuel-impervious sintered metal material and having an outer circumferential surface adapted to be press fit mounted within the vapor recirculation pipe and having opposed ends;

a flow passage of tortuous shape extending through the plug between the opposed ends, said flow passage being a meandering channel that is provided on the outer cylindrical surface of the plug so that the flow passage is defined between the meandering channel and the inside pipe wall;

whereby the tortuous shape of the flow passage permits the flow of fuel vapor through the plug but prevents the flow of liquid fuel through the plug.

2. The flow-restricting plug of claim 1 in which the flow passage is comprised of a plurality of meandering channels that are provided on the outer cylindrical surface of the plug.

3. The flow-restricting plug of claim 1 in which the flow passage has a first end opening in one of the opposed walls of the plug, and a second end opening in the other of the opposed walls of the plug, and the meandering channel extends between the first end opening and the second end opening and the shape of the meandering channel is such that there is no line of sight through the plug from the first end opening to the second end opening.

4. A flow-restricting plug for installation within the inside pipe wall of a vapor recirculation pipe that communicates with a fuel filler pipe, comprising:

a cylindrical plug having opposed end walls and having an outer cylindrical surface adapted to be press fit within the inside pipe wall of the vapor recirculation pipe;

at least one meandering channel of tortuous shape formed on the outer cylindrical surface of the plug and extending between the opposed end walls cooperating with the inside pipe wall to form a tortuous flow passage extending through the plug between the opposed ends, said meandering channel being sized and shaped to permit the flow of fuel vapor through the plug but prevent the flow of liquid fuel through the plug.

5. The flow-restricting plug of claim 4 in which a plurality of meandering channels of tortuous shape are provided on the outer cylindrical surface of the plug.

6. The flow-restricting plug of claim 4 in which the shape of the meandering channel is such that there is no line of sight through the plug.

7. The flow-restricting plug of claim 4 in which the plug is manufactured of fuel-impervious sintered metal.

8. The flow-restricting plug of claim 4 in which the plug is manufactured of sintered metal and the shape of the meandering channel blocks line of sight through the plug.

9. A flow-restricting plug for installation within the inside pipe wall of a vapor recirculation pipe that communicates with a fuel filler pipe, comprising:

a cylindrical plug of fuel-impervious sintered metal having an outer cylindrical surface that extends between opposed ends of the plug and said outer cylindrical surface adapted for press fit within the inside pipe wall of the vapor recirculation pipe;

a plurality of meandering channels of tortuous shape formed on the outer cylindrical surface of the plug and extending between the opposed end walls to cooperate with the inside pipe wall to form a tortuous flow passage extending through the plug between the opposed plug ends, said meandering channels being sized and shaped such that there is no line of sight through the plug to permit the flow of fuel vapor through the plug but prevent the flow of liquid fuel through the plug.

* * * * *